US011511929B2

(12) United States Patent
Ness et al.

(10) Patent No.: US 11,511,929 B2
(45) Date of Patent: Nov. 29, 2022

(54) METALLIC CONTAINER DOME CONFIGURED TO DEFORM AT A PREDETERMINED PRESSURE

(71) Applicant: Ball Metalpack, LLC, Broomfield, CO (US)

(72) Inventors: David J. Ness, Arvada, CO (US); Rick L. Lord, Westminster, CO (US)

(73) Assignee: Ball Metalpack, LLC, Broomfield, CO (US)

( * ) Notice: Subject to any disclaimer, the term of this patent is extended or adjusted under 35 U.S.C. 154(b) by 0 days.

(21) Appl. No.: 17/101,304

(22) Filed: Nov. 23, 2020

(65) Prior Publication Data

US 2021/0070534 A1 Mar. 11, 2021

Related U.S. Application Data

(62) Division of application No. 15/981,413, filed on May 16, 2018, now Pat. No. 10,843,864.

(60) Provisional application No. 62/507,462, filed on May 17, 2017.

(51) Int. Cl.

| | |
|---|---|
| ***B65D 83/38*** | (2006.01) |
| ***B21D 22/28*** | (2006.01) |
| ***B21D 51/24*** | (2006.01) |
| ***B21D 22/30*** | (2006.01) |

(52) U.S. Cl.

CPC ..... *B65D 83/38* (2013.01); *B21D 22/28* (2013.01); *B21D 22/30* (2013.01); *B21D 51/24* (2013.01)

(58) Field of Classification Search

CPC ..... B21D 22/20; B21D 22/24; B21D 22/26; B21D 22/28; B21D 22/30; B21D 51/24; B65D 79/0081

USPC ..... 72/347, 348; 220/604, 608, 610, 623, 220/624

See application file for complete search history.

(56) References Cited

U.S. PATENT DOCUMENTS

| | | | | |
|---|---|---|---|---|
| 2,795,350 | A | 6/1957 | Lapin | |
| 3,292,826 | A | 12/1966 | Ablanalp | |
| 3,786,967 | A | 1/1974 | Giocomo et al. | |
| 3,826,412 | A | 7/1974 | Kneusel | |
| 3,831,822 | A | 8/1974 | Zundel | |
| 3,850,339 | A | 11/1974 | Kinkel | |
| 4,003,505 | A | 1/1977 | Hardt | |
| 4,513,874 | A | 4/1985 | Mulawski | |
| 4,580,690 | A * | 4/1986 | Mulawski | B65D 83/70 220/89.2 |

(Continued)

FOREIGN PATENT DOCUMENTS

| | | |
|---|---|---|
| WO | 2013/124480 A1 | 8/2013 |

*Primary Examiner* — Adam J Eiseman
*Assistant Examiner* — Fred C Hammers
(74) *Attorney, Agent, or Firm* — Nelson Mullins Riley & Scarborough LLP

(57) ABSTRACT

Methods and apparatus for forming a metallic dome are provided. More specifically, the present invention relates to a metallic dome that may be used to seal an aerosol container. The metallic dome includes a novel flattened relief panel and an inwardly oriented arch configured to deform in response to pressure within the aerosol container exceeding a predetermined amount. In one embodiment, the flattened relief panel is substantially planar. Optionally, the metallic dome includes at least a first inwardly oriented arch with a first radius of curvature and a second inwardly oriented arch with a second radius of curvature.

23 Claims, 10 Drawing Sheets

(56) References Cited

U.S. PATENT DOCUMENTS

| | | | | |
|---|---|---|---|---|
| 4,588,101 | A | 5/1986 | Ruegg | |
| 5,217,139 | A | 6/1993 | Miczka et al. | |
| 5,249,701 | A | 10/1993 | Daehn | |
| 5,829,623 | A | 11/1998 | Otsuka et al. | |
| 5,836,473 | A * | 11/1998 | Jentzsch | B65D 1/0276 220/606 |
| 5,915,595 | A | 6/1999 | Dow et al. | |
| 6,830,419 | B1 | 12/2004 | Turner et al. | |
| 7,222,757 | B2 | 5/2007 | Ferreira et al. | |
| 7,971,759 | B2 | 7/2011 | Dalan et al. | |
| 9,499,330 | B2 | 11/2016 | Henry et al. | |
| 2004/0035871 | A1 * | 2/2004 | Chupak | B21D 51/2615 220/608 |
| 2009/0223956 | A1 | 9/2009 | Matsukawa et al. | |
| 2010/0044399 | A1 | 2/2010 | Dalan et al. | |
| 2010/0127001 | A1 * | 5/2010 | Niec | B65D 79/0081 220/609 |
| 2017/0095852 | A1 * | 4/2017 | Carstens | B21D 22/30 |
| 2017/0361971 | A1 * | 12/2017 | Jentzsch | B21D 51/2684 |

* cited by examiner

METALLIC CONTAINER DOME CONFIGURED TO DEFORM AT A PREDETERMINED PRESSURE

CROSS-REFERENCE TO RELATED APPLICATIONS

This application is a divisional of U.S. application Ser. No. 15/981,413, filed May 26, 2018, now U.S. Pat. No. 10,843,864, which claims priority under 35 U.S.C. § 119(e) to U.S. Provisional Patent Application Ser. No. 62/507,462, filed May 17, 2017, the contents of each of which are incorporated herein by reference in their entirety.

FIELD OF THE INVENTION

The present invention relates generally to the manufacturing of metallic container bodies. More specifically, the present invention relates to methods and apparatus for forming a metallic dome for interconnection to a lower portion of a metallic container, the metallic dome including a pressure relief feature.

BACKGROUND

Metallic aerosol containers offer distributors and consumers many benefits. The metallic body of a container provides optimal protection properties for products. For example, the metallic body prevents $CO_2$ migration and UV radiation which may damage personal care, pharmaceutical, and food products and other UV-sensitive formulations, negatively influencing the effectiveness of ingredients, as well as the fragrance, flavor, appearance, or color of the product. Metallic aerosol containers also offer an impermeable barrier to light, water vapor, oils and fats, oxygen, and micro-organisms and keep the contents of the container fresh and protected from external influences, thereby guaranteeing a long shelf-life. Products stored in metallic aerosol containers are also not waisted due to evaporation.

Additionally, the increased durability of metallic aerosol containers compared to glass and plastic containers reduces the number of containers damaged during processing and shipping, resulting in further savings. For example, metallic aerosol containers have significant durability and are difficult to deform or burst and thus are highly valuable for holding products under pressure. Metallic aerosol containers are also lighter than glass containers of a similar volume resulting in energy savings during shipment. Finally, recycling metallic container bodies is easier than recycling glass and plastic containers because labels and other indicia are printed directly onto the metallic body while glass and plastic containers typically have labels that must be separated during the recycling process.

Methods of manufacturing metallic aerosol containers are known in the container industry. One method of manufacturing metallic aerosol containers is a draw and wall ironing (DWI) process in which a blank-and-draw press cuts a generally circular blank of a predetermined diameter from a coil. The blank is drawn into an aerosol container body in a number of draw, redraw, and ironing operations.

Alternatively, metallic aerosol containers can also be formed at least partially by an impact extrusion process. Impact extrusion is a process utilized to make metallic containers and other articles from metallic slugs. The metallic container body is formed inside a confining die from a cold slug which is contacted by a punch. The force from the punch deforms the metal slug around an outer diameter of the punch and the inner diameter of the confining die to make a formed cup. The cup is transferred to a second press where it is redrawn and ironed to form the aerosol container body.

Referring now to FIG. 1A, a container body 4 for an aerosol container 2 is generally illustrated. The container body 4 may be formed by either a DWI process or an impact extrusion process and includes an open end 6A, a sidewall 8A extending upwardly to a shoulder 10 with a reduced diameter, and an opening 12 positioned on an uppermost portion of the shoulder 10. The opening 12 is configured to receive a valve to dispense a product stored in the container body. Optionally, as illustrated in FIG. 1B, the sidewall 8B may be necked to a reduced diameter proximate to the open-end 6B. The open end 6 of the container body 4 subsequently receives an aerosol bottom or a metallic dome 14 to seal the aerosol container 2. The metallic dome 14 frequently includes an inwardly oriented arch 16 with a concave shape pointing toward the opening 12.

Aerosol containers filled with product under pressure must be designed to withstand a change in internal pressure. For example, when an aerosol container is left in sunlight or stored in a hot place for a period of time, the pressure within the aerosol container may increase due to thermal expansion of the product. The increase in pressure can cause catastrophic failure when the container explodes. These variations in internal pressure are especially common during transportation of aerosol containers when the temperature inside of a truck trailer can vary greatly. In order to prevent rupture of the aerosol container and thus spoilage to other containers, aerosol containers frequently include pressure relief mechanisms in a variety of locations, including formed on the metallic dome. Some pressure relief mechanisms include notches or scores in the metallic dome. When pressure within the aerosol container increases beyond a predetermined level, the scores rupture to release the pressure of the aerosol container. Pressure relief mechanisms may also include a portion of the metallic dome that is designed to expand such that the volume of the container increases to reduce pressure within the aerosol container. Seams used to join the metallic dome to the container body may also be configured to unwrap to vent the product or to increase the volume of the aerosol container. Examples of prior art metallic domes and pressure relief mechanisms for aerosol containers are generally described in U.S. Pat. Nos. 2,795,350; 3,292,826; 3,786,967; 3,826,412; 3,831,822; 3,850,339; 4,003,505, 4,513,874; 4,580,690; 4,588,101; 5,249,701; 5,915,595; 6,830,419; 7,222,757; 7,971,759; 9,499,330; and U.S. Pat. App. Pub. No. 2009/0223956 which are each incorporated herein in their entirety by reference. Government agencies frequently issue safety regulations that specify pressure limits and pressure relief requirements for pressurized vessels, such as aerosol containers, being transported by common carriers. One example includes the U.S. Department of Transportation regulations related to shipment of packages containing compressed gases known as the "2P1 DOT Aerosol Bottom Specification" published as 49 CFR § 173.306 which is incorporated herein in its entirety by reference.

These prior art pressure relief mechanisms have several deficiencies. More specifically, some pressure relief mechanisms which are designed to increase the volume of the aerosol container do not perform consistently and predictably. Instead, the pressure relief mechanism may roll-out or otherwise expand inconsistently or incompletely such that the volume of the aerosol container does not increase as intended. Thus, pressure within the aerosol container does not decrease as expected or by a sufficient amount. An uncontrolled failure of the aerosol container may thus occur resulting in spoilage or damage to other containers or products stored in the same packaging, vehicle, or storage area.

Pressure relief mechanisms with scores or notches may fail prematurely, or at an unnecessarily low pressure. After the scores rupture, the aerosol container may have sharp edges which are particularly dangerous. The scores are also known to corrode over time which may lead to failure of the aerosol container.

Pressure relief mechanisms that vent the contents of the aerosol container are also undesirable because the vented product may be dangerous or cause health concerns when inhaled or through contact with a person's skin or eyes. This can cause problems when an aerosol container in an unventilated space, such as a warehouse or tractor-trailer, vents its contents through a pressure relief score. Additionally, an aerosol container that ruptures or vents its contents can cause spoilage of other containers when the container product sprays onto other aerosol containers or packages. As one of skill in the art will appreciate, the vented product may damage other containers or mar packaging and decorations making the other aerosol containers unsaleable.

Due to the limitations and shortcomings associated with current pressure relief mechanisms for aerosol containers there is an unmet need for apparatus and methods of producing a pressure relief system for a metallic dome that performs more consistently, which does not lead to premature failure and spoilage of product stored in the aerosol container, and which is economical to produce.

SUMMARY OF THE INVENTION

The present invention provides a novel metallic dome for an aerosol container and a novel apparatus and method for shaping the metallic dome. The metallic dome includes a novel inwardly oriented arch and a flattened relief panel. The flattened relief panel is substantially centered on a central axis of the metallic dome. In one embodiment, the inwardly oriented arch has an arcuate cross section. Optionally, the inwardly oriented arch may have a substantially constant radius of curvature. Alternatively, the metallic dome can include two or more inwardly oriented arches with each arch having a different radius of curvature.

One aspect of the present invention is a metallic dome for a two-piece or a three-piece aerosol container. The metallic dome includes a flattened relief panel and an inwardly oriented arch having a geometry configured to buckle or deform outwardly when pressure within the aerosol container exceeds a predetermined amount. More specifically, the metallic dome is configured to deform such that the volume of an aerosol container to which the metallic dome is interconnected increases to prevent failure of the aerosol container, such as a rupture or seam separation. In one embodiment, the flattened relief panel is substantially centered on the metallic dome. The inwardly oriented arch may have a generally arcuate shape. In one embodiment, the inwardly oriented arch has a generally uniform radius of curvature. Alternatively, the metallic dome may be formed from two or more inwardly oriented arches with each arch having a different radius of curvature. In one embodiment, the metallic dome has a diameter selected to fit an aerosol container with a diameter of approximately $2^{10}/_{16}$ inches which is commonly known as a 210 container; however, the metallic dome may have a diameter selected to fit an aerosol container of any diameter.

Another aspect of the present invention is an aerosol container with a metallic dome having controlled buckling or deformation characteristics. The aerosol container generally includes: an open-end, a sidewall extending upwardly to a shoulder, an opening at an uppermost portion of the shoulder, and a metallic dome interconnected to the open-end. The opening is configured to receive a valve to dispense a product stored in the aerosol container. The metallic dome includes a peripheral curl seamed to the open end of the container sidewall, a countersink, an inwardly oriented arch, and a flattened relief panel that is substantially linear. The flattened relief panel is substantially centered on a longitudinal axis of the aerosol container. The aerosol container is one of a two-piece and a three-piece aerosol container.

In one embodiment, the inwardly oriented arch has a cross-sectional profile with a generally constant radius of curvature. Alternatively, the metallic dome may comprise two or more inwardly oriented arches, each arch having a different radius of curvature. In one embodiment, the metallic dome has four inwardly oriented arches each having a different radius of curvature. The flattened relief panel reduces the rigidity of the metallic dome. In one embodiment, the metallic dome of the present invention can withstand a pressure of up to at least approximately 225 psig without bursting or releasing a product. Additionally, in one embodiment, the metallic dome can withstand a pressure of up to approximately 275 psig without bursting or releasing a product. In one embodiment, the metallic dome is devoid of scores and coins. Optionally, no score or coins are formed on at least the flattened relief panel. In another embodiment, the metallic dome has a material thickness that is substantially uniform through the entire dome.

The geometry of the metallic dome has been found to have unexpected results compared to prior art metallic domes. For example, the metallic domes of the present invention deform more reliably and consistently to reduce pressure within an aerosol container and without venting product compared to prior art metallic domes. Specifically, the metallic domes of the present invention are adapted to deform to reduce pressure and may subsequently vent product only when further release of pressure is required. In contrast, prior art metallic domes of similar size and material typically buckle and burst approximately at substantially the same time, and at considerably lower pressures, than the metallic dome of the present invention. Further, some prior art metallic domes have been formed to fail in a catastrophic manner.

Still another aspect of the present invention is a metallic dome for a two-piece or a three-piece aerosol container, the metallic dome having controlled buckling or deformation characteristics. The metallic dome generally includes: a peripheral curl, a countersink, an inwardly oriented arch, and a flattened relief panel. The peripheral curl is adapted to be interconnected to an open end of a body of the aerosol container. The flattened relief panel has a diameter that is a predetermined percentage of a diameter of the countersink.

The geometry of the inwardly oriented arch and the flattened relief panel reduce the structural integrity of the metallic dome such that the metallic dome deforms in response to exposure to a predetermined pressure. In one embodiment, the metallic dome is configured to deform by rolling or expanding outwardly. In one embodiment, the predetermined pressure at which the metallic dome deforms is greater than approximately 160 psig. In another embodiment, the predetermined pressure is at least approximately 225 psig. In another embodiment, the predetermined pressure is at least approximately 230 psig. In still another embodiment, the predetermined pressure is at least approximately 225 psig but is less than approximately 275 psig. In another embodiment, the pressure is between approximately 230 psig and approximately 280 psig. In one embodiment, the predetermined pressure is between approximately 160 psig and approximately 280 psig.

The metallic dome may include a first inwardly oriented arch with a first outer end, a first inner end, and a first medial portion with a first radius of curvature. The first inwardly oriented arch is configured to be interconnected on the first outer end to an interior portion of the countersink. Optionally, in one embodiment, the metallic dome includes a second inwardly oriented arch having a second outer end, a second inner end, and a second medial portion with a second radius of curvature. The second inwardly oriented arch is interconnected on the second outer end to the first inner end of the first inwardly oriented arch. The first radius of curvature and the second radius of curvature are different.

In another embodiment, the metallic dome includes a third inwardly oriented arch with a third outer end, a third inner end, and a third medial portion with a third radius of curvature. The third inwardly oriented arch may be interconnected on the third outer end to the second inner end of the second inwardly oriented arch.

Optionally, in still another embodiment, the metallic dome can include a fourth inwardly oriented arch having a fourth outer end, a fourth inner end, and a fourth medial portion with a fourth radius of curvature. The fourth inwardly oriented arch can be interconnected on the fourth outer end to the third inner end of the third inwardly oriented arch. In one embodiment, each of the first, second, third, and fourth radii of curvature are different.

The flattened relief panel is interconnected to the inner end of one of the first, second, third, and fourth inwardly oriented arches. In one embodiment, the flattened relief panel is interconnected to the second inner end of the second inwardly oriented arch. Alternatively, the flattened relief panel is interconnected to the fourth inner end of the fourth inwardly oriented arch.

One aspect of the present invention is a metallic dome for an aerosol container that includes a predetermined geometry configured to deform at a first pressure. The aerosol container may be of any size or shape. In one embodiment, the aerosol container is a 2-piece aerosol container. Alternatively, the aerosol container is a 3-piece aerosol container.

In one embodiment, the metallic dome includes a flattened relief panel and one or more inwardly oriented arches. The geometry of the inwardly oriented arches and the flattened relief panel are configured such that the dome rolls outwardly or otherwise deforms when pressure within the aerosol container reaches the first pressure. In this manner, the metallic dome increases the volume of the aerosol container and decreases pressure within the aerosol container. The first pressure is less than a second pressure at which the metallic container is configured to vent its contents in a controlled manner. In one embodiment, the first pressure is at least approximately 225 psig. In another embodiment, the first pressure is at least approximately 230 psig. In one embodiment, the second pressure at which the metallic container vents its contents is at least approximately 240 psig. In another embodiment, the second pressure is at least approximately 275 psig. In still another embodiment, the second pressure is at least approximately 280 psig. Accordingly, the metallic dome is designed to meet or exceed the U.S. Department of Transportation 2P1 DOT Aerosol Bottom Specification published at 49 CFR § 173.306.

Another aspect of the present invention is a forming tool for an apparatus that forms a metallic dome for aerosol containers, the metallic dome including an inwardly oriented arch and a flattened relief panel with a geometry selected to deform at a predetermined pressure. The forming tool generally includes a body portion and a face portion. The body portion is configured to be interconnected to a tooling assembly of the apparatus.

The face portion generally includes at least one outwardly oriented arch and a flattened portion. The flattened portion is configured to form a corresponding flattened relief panel in the metallic dome. In one embodiment, the flattened portion is substantially centered on a longitudinal axis of the forming tool.

Optionally the at least one outwardly oriented arch comprises one outwardly oriented arch with a substantially constant radius of curvature. Alternatively, the face portion may comprise at least a first outwardly oriented arch and a second outwardly oriented arch. The first and second outwardly oriented arches may have different first and second radii of curvature. In another embodiment, the face portion optionally includes a third outwardly oriented arch with a third radius of curvature, the third outwardly oriented arch interconnected to the second outwardly oriented arch. Additionally, in another embodiment, the face portion further includes a fourth outwardly oriented arch with a fourth radius of curvature. The fourth outwardly oriented arch may be interconnected to the third outwardly oriented arch and to the flattened portion.

Another aspect of the present invention is a forming tool which is configured to replace a dome forming tool of a prior art tooling assembly. The forming tool has a face with a predetermined profile to produce a metallic dome for an aerosol container. The metallic dome has a geometry configured to deform in response to a predetermined pressure. In this manner, the tooling assembly may be modified to produce a metallic dome of the present invention by replacing only one tool of the tooling assembly with the forming tool of the present invention. Thus, the metallic dome of the present invention is economical to produce.

Still another aspect of the present invention is a method of making a metallic dome adapted to deform to relieve pressure within an aerosol container. The method generally includes, but is not limited to, one or more of: (1) providing a blank of metallic material; (2) loading the blank into a tooling assembly; (3) forming the blank into a metallic dome which includes one or more of: (a) a peripheral curl for interconnection to an open lower end of a sidewall of the aerosol container, the peripheral curl having an interior diameter; (b) a first inwardly oriented arch interconnected to the peripheral curl and having a first radius of curvature; (c) a second inwardly oriented arch interconnected to the first inwardly oriented arch and having a second radius of curvature; (d) a third inwardly oriented arch interconnected to the second inwardly oriented arch and having a third radius of curvature; (e) a fourth inwardly oriented arch interconnected to the third inwardly oriented arch and having a fourth radius of curvature; and (f) a flattened relief panel interconnected to one of the first, second, third, and fourth inwardly oriented arches. In one embodiment, the flattened relief panel has a diameter which is between approximately 18.0% and approximately 19.4% of the interior diameter of the peripheral curl. In another embodiment, the flattened relief panel has a surface area which is between approximately 2% and approximately 5.6% of a surface area of the metallic dome.

One aspect of the present invention is a metallic dome adapted to deform to relieve pressure within an aerosol container. The metallic dome may include, but is not limited to: (1) a peripheral curl configured for interconnection to an open lower end of a sidewall of the aerosol container, the peripheral curl having an interior diameter; (2) an inwardly oriented arch with a first outer end, a first inner end, and a first medial portion with a first radius of curvature, the first outer end interconnected to the peripheral curl; (3) a second inwardly oriented arch interconnected on a second outer end to the first inner end of the first inwardly oriented arch, the second inwardly oriented arch having a second inner end and a second medial portion with a second radius of curvature; and (4) a flattened relief panel interconnected to the second inner end of the second inwardly oriented arch, the flattened relief panel being substantially linear and having a diameter which is between approximately 18.0% and approximately 19.4% of the interior diameter of the peripheral curl. In one embodiment, the first radius of curvature is at least three times greater than the second radius of curvature. In another embodiment, the flattened relief panel has a surface area which is between approximately 2% and approximately 5.6% of a surface area of the metallic dome.

Optionally, the metallic dome may further include a third inwardly oriented arch with a third outer end, a third inner end, and a third medial portion with a third radius of curvature. The third inwardly oriented arch may be interconnected on the third outer end to the second inner end of the second inwardly oriented arch. Additionally, the metallic dome may also include a fourth inwardly oriented arch with a fourth outer end, a fourth inner end, and a fourth medial portion with a fourth radius of curvature. The fourth inwardly oriented arch can be interconnected on the fourth outer end to the third inner end of the third inwardly oriented arch and to the flattened relief panel on the fourth inner end.

It is another aspect of the present invention to provide a forming tool to shape a metallic dome for an aerosol container, the metallic dome having a geometry configured to deform in response to a predetermined pressure within the aerosol container. The forming tool comprises: (1) a body portion configured to be interconnected to a tooling assembly; and (2) a face portion to shape an inwardly oriented arch of the metallic dome, the face portion having a first diameter. The face portion may include, but is not limited to: (a) a first outwardly oriented arch with a first radius of curvature; (b) a second outwardly oriented arch having a second radius of curvature interconnected to the first outwardly oriented arch; and (c) a flattened portion which is substantially linear. The flattened portion has a second diameter. In one embodiment, the second diameter can optionally be between approximately 17% and approximately 21% of the first diameter.

Additionally, the face portion can also include a third outwardly oriented arch interconnected to the second outwardly oriented arch. In one embodiment, the third outwardly oriented arch has a third radius of curvature that is greater than the first radius of curvature. Optionally, the face portion further comprises a fourth outwardly oriented arch interconnected to the third outwardly oriented arch and to the flattened portion. The fourth outwardly oriented arch may have a fourth radius of curvature that optionally is approximately one-fifth of the third radius of curvature.

In one embodiment, the second radius of curvature of the second outwardly oriented arch is less than approximately one-fourth of the first radius of curvature. Optionally, in another embodiment, the second radius of curvature is approximately one-fifth of the first radius of curvature. The second radius of curvature has a center forming a third diameter parallel to the first diameter. In one embodiment, the third diameter can be between approximately 65% and approximately 70% of the first diameter.

Although generally referred to herein as a "two-piece aerosol container," a "three-piece aerosol container," or an "aerosol container," it should be appreciated that the methods and apparatus described herein may be used with containers of any size or shape, for any type of product, and formed of any metal material. Accordingly, the term "container" is intended to cover containers of any type, such as beverage containers, and is not limited to aerosol containers.

Although generally referred to herein as "aerosol containers," "metallic aerosol container bodies," and/or "metallic containers," it should be appreciated that the methods and apparatus of embodiments of the current invention may be used to form any variety of containers or other articles of manufacture of any size or shape and for any type of product. Further, as will be appreciated by one of skill in the art, the method and apparatus of embodiments of the current invention may be used to form metallic domes for aerosol container bodies of any material, including aluminum, tin, steel, and combinations thereof.

The terms "metal" or "metallic" as used hereinto refer to any metallic material that may be used to form a container, including without limitation aluminum, steel, tin, and any combination thereof.

The phrases "at least one," "one or more," and "and/or," as used herein, are open-ended expressions that are both conjunctive and disjunctive in operation. For example, each of the expressions "at least one of A, B and C," "at least one of A, B, or C," "one or more of A, B, and C," "one or more of A, B, or C," and "A, B, and/or C" means A alone, B alone, C alone, A and B together, A and C together, B and C together, or A, B and C together.

Unless otherwise indicated, all numbers expressing quantities, dimensions, conditions, and so forth used in the specification and claims are to be understood as being modified in all instances by the terms "approximately" or "about." In one embodiment, all dimensions, quantities, and percentages may be varied by up to approximately 15%.

The term "a" or "an" entity, as used herein, refers to one or more of that entity. As such, the terms "a" (or "an"), "one or more" and "at least one" can be used interchangeably herein.

The use of "including," "comprising," or "having" and variations thereof herein is meant to encompass the items listed thereafter and equivalents thereof as well as additional items. Accordingly, the terms "including," "comprising," or "having" and variations thereof can be used interchangeably herein.

It shall be understood that the term "means" as used herein shall be given its broadest possible interpretation in accordance with 35 U.S.C., Section 112(f). Accordingly, a claim incorporating the term "means" shall cover all structures, materials, or acts set forth herein, and all of the equivalents thereof. Further, the structures, materials, or acts and the equivalents thereof shall include all those described in the Summary of the Invention, Brief Description of the Drawings, Detailed Description, Abstract, and Claims themselves.

The Summary of the Invention is neither intended, nor should it be construed, as being representative of the full extent and scope of the present invention. Moreover, references made herein to "the present invention" or aspects thereof should be understood to mean certain embodiments of the present invention and should not necessarily be construed as limiting all embodiments to a particular description. The present invention is set forth in various levels of detail in the Summary of the Invention as well as in the attached drawings and the Detailed Description and no limitation as to the scope of the present invention is intended by either the inclusion or non-inclusion of elements or components. As will be appreciated, other embodiments are possible using, alone or in combination, one or more of the features set forth above or described below. For example, it is contemplated that various features and devices shown and/or described with respect to one embodiment may be combined with or substituted for features or devices of other embodiments regardless of whether or not such a combination or substitution is specifically shown or described herein. Additional aspects of the present invention will become more readily apparent from the Detailed Description, particularly when taken together with the drawings.

BRIEF DESCRIPTION OF THE DRAWINGS

The accompanying drawings, which are incorporated herein and constitute a part of the specification, illustrate embodiments of the invention and together with the Summary of the Invention given above and the Detailed Description given below serve to explain the principles of these embodiments. In certain instances, details that are not necessary for an understanding of the disclosure or that render other details difficult to perceive may have been omitted. It should be understood, of course, that the present invention is not necessarily limited to the particular embodiments illustrated herein. Additionally, it should be understood that the drawings are not necessarily to scale.

Figure 1A:
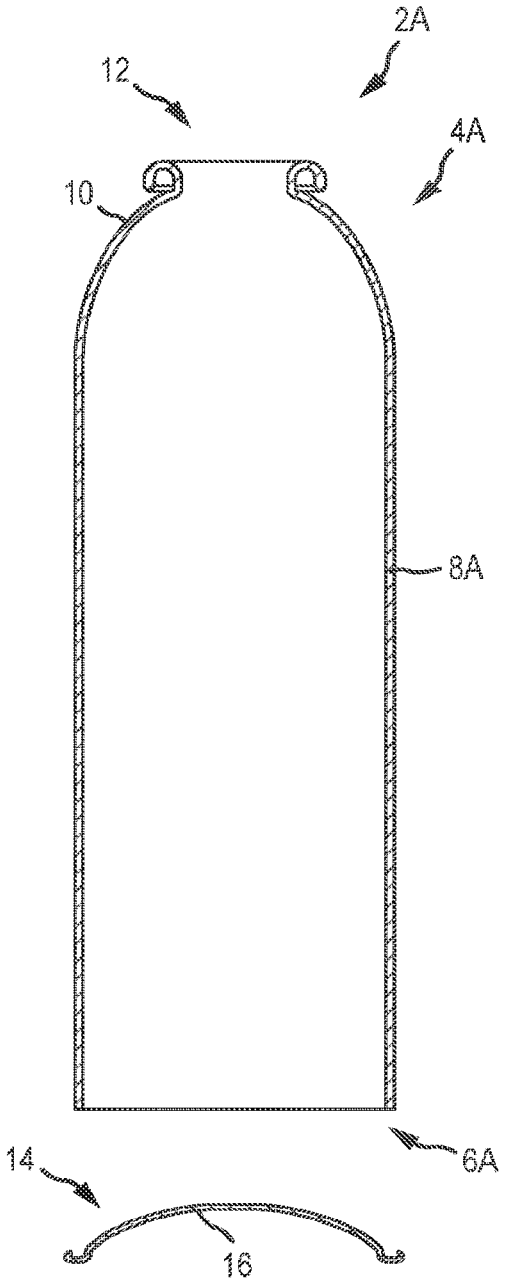
FIG. 1A (PRIOR ART)
FIG. 1A is a cross-sectional view of a prior art container body and a metallic dome of an aerosol container.
Figure 1B:
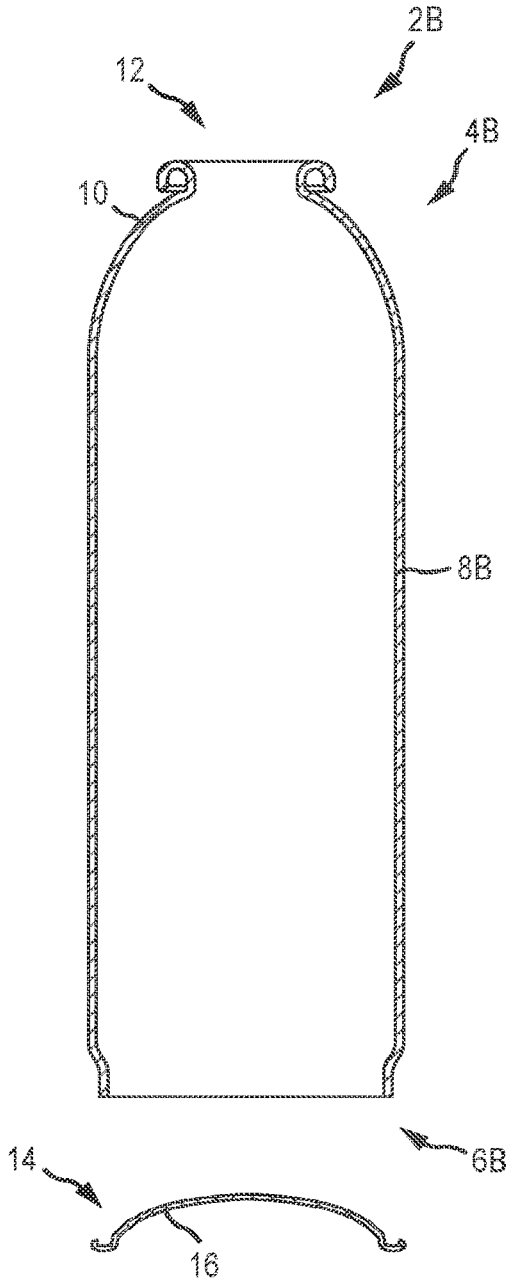
FIG. 1B (PRIOR ART)
FIG. 1B is a cross-sectional view of another prior art container body and metallic dome for an aerosol container.

To assist in the understanding of one embodiment of the present invention the following list of components and associated numbering found in the drawings is provided herein:

NUMBER COMPONENT

2 Aerosol container
4 Container body
6 Open end
8 Sidewall
10 Shoulder
12 Opening
14 Metallic dome
16 Inwardly oriented arch
18 Tooling assembly
20 Lift ring
22 Draw punch
24 Draw punch insert
26 Forming tool
28 Longitudinal axis
30 Height of forming tool
32 Body portion
34 Body Diameter
36 Body Height
38 Distal end of body
40 Face of forming tool
42 Diameter of face portion
44 Flattened portion
46 Diameter of flattened portion
50 Outwardly oriented arch
52 First outwardly oriented arch
54 Second outwardly oriented arch
56 Third outwardly oriented arch
58 Fourth outwardly oriented arch
60 Second radius of curvature center diameter
62 Fourth radius of curvature center diameter
66 Metallic dome
68 Height of metallic dome
70 Peripheral curl
72 Curl diameter
74 Countersink
76 Countersink or interior diameter
77 Countersink radius of curvature center
78 Countersink depth
80 Arched portion
82 First inwardly oriented arch
84 Second inwardly oriented arch
86 Third inwardly oriented arch
88 Fourth inwardly oriented arch
90 Flattened relief panel
92 Diameter of flattened relief panel
94 Brim

96 Brim width
102 Aerosol container
104 Container body
106 Open end
108 Sidewall
110 Shoulder
112 Opening
114 Seam
116 Gap
120 Stress scale
122 Line indicated predicted yield strength
124 First portion of arch
126 Second portion of arch
R1 First radius of curvature
C1 Center of first radius of curvature
R2 Second radius of curvature
C2 Center of second radius of curvature
R3 Third radius of curvature
C3 Center of third radius of curvature
R4 Fourth radius of curvature
C4 Center of fourth radius of curvature

DETAILED DESCRIPTION

The present invention has significant benefits across a broad spectrum of endeavors. It is the Applicant's intent that this specification and the claims appended hereto be accorded a breadth in keeping with the scope and spirit of the invention being disclosed despite what might appear to be limiting language imposed by the requirements of referring to the specific examples disclosed. To acquaint persons skilled in the pertinent arts most closely related to the present invention, a preferred embodiment that illustrates the best mode now contemplated for putting the invention into practice is described herein by, and with reference to, the annexed drawings that form a part of the specification. The exemplary embodiment is described in detail without attempting to describe all of the various forms and modifications in which the invention might be embodied. As such, the embodiments described herein are illustrative, and as will become apparent to those skilled in the arts, may be modified in numerous ways within the scope and spirit of the invention.

Figure 2:
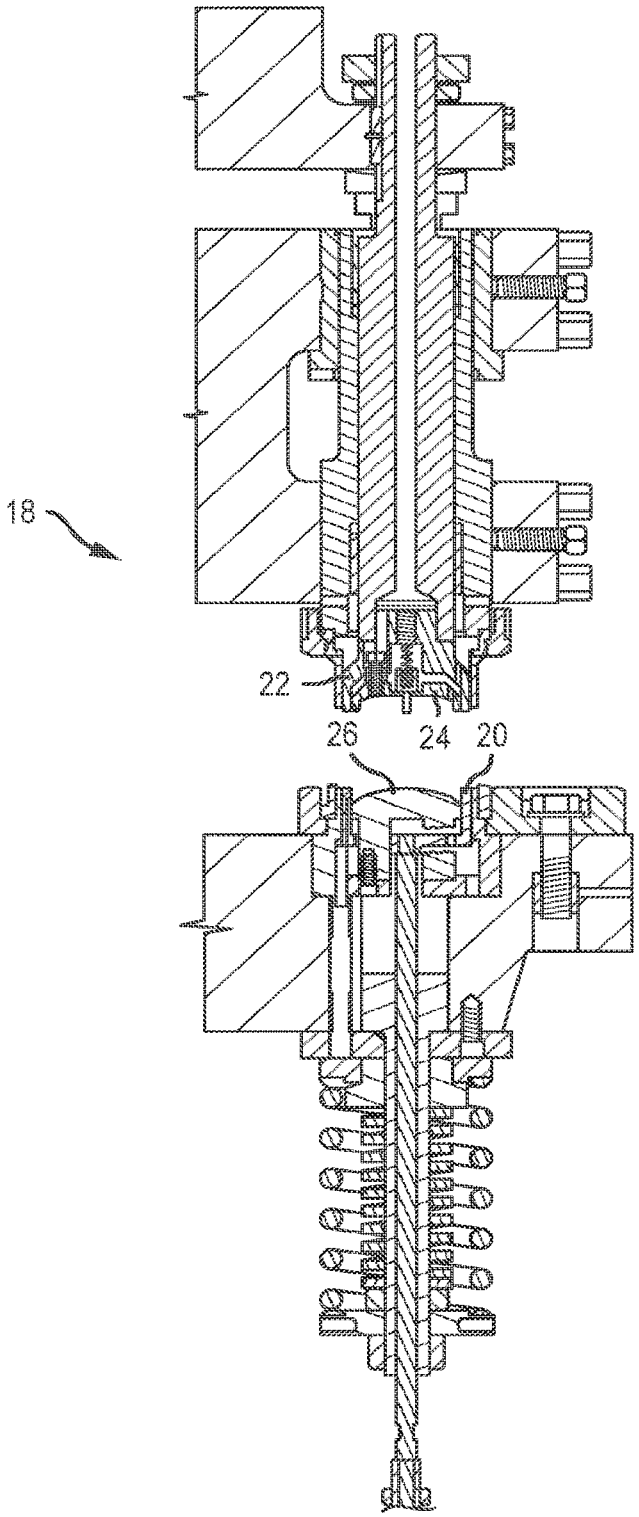
FIG. 2 is a cross-sectional view of a tooling assembly including a forming tool of one embodiment of the present invention.

Referring now to FIG. 2, a tooling assembly 18 with a forming tool 26 of one embodiment of the present invention is generally illustrated. The forming tool 26 is positioned proximate to a lift ring 20. A draw punch 22 with a draw punch insert 24 is positioned in an opposing relationship to the forming tool 26. The forming tool 26, lift ring 20, draw punch 22, and draw punch insert 24 are generally concentrically aligned with a longitudinal axis of the tooling assembly.

Figure 4:
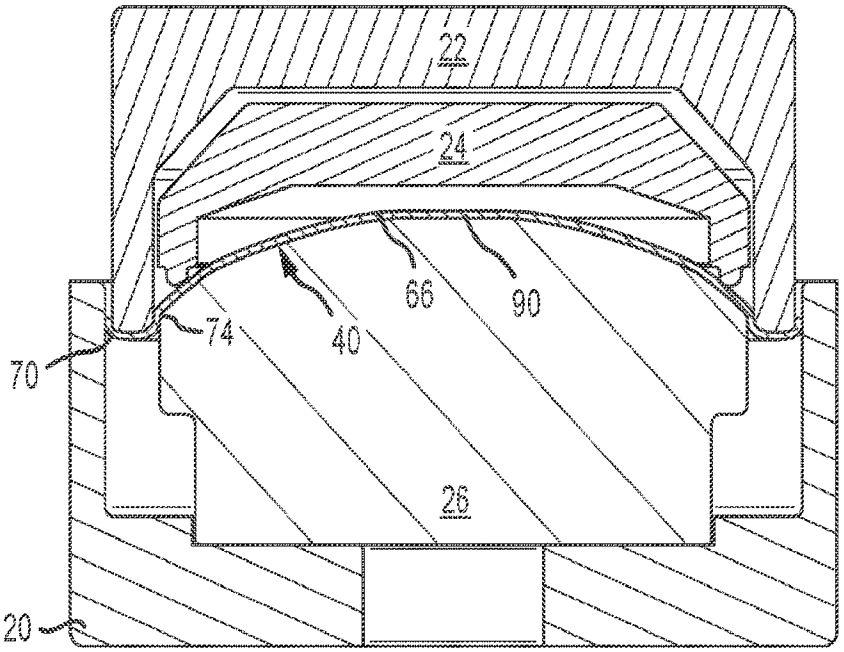
FIG. 4 is a front elevation view of the forming tool and metallic dome of FIG. 3 in relation to other tools of the tooling assembly.
Figure 3:
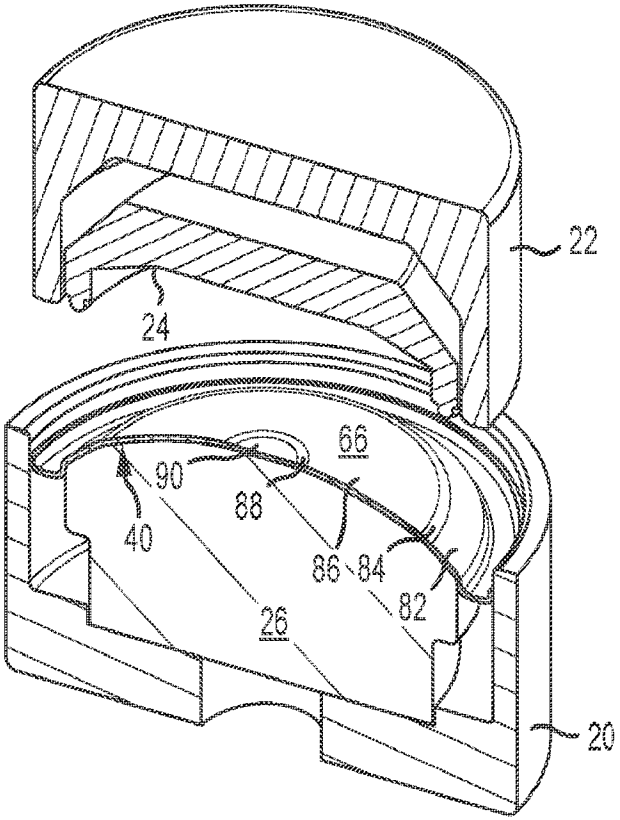
FIG. 3 is an expanded perspective view of a portion of the forming tool and other tools of the tooling assembly of FIG. 2 shaping a metallic dome of the present invention.

Referring now to FIGS. 3-4, expanded views of the forming tool 26 forming a metallic dome 66 of one embodiment of the present invention are illustrated. A face 40 of the forming tool 26 has a shape configured to form or shape a predetermined geometry in the metallic dome 66. The lift ring 20, draw punch 22, draw punch insert 24, and the forming tool 26 also interact to form a peripheral curl 70 and countersink 74 with predetermined geometries on the metallic dome 66. In one embodiment, generally illustrated in FIG. 4, at least a flattened relief panel 90 of the metallic dome is spaced from the draw punch insert 24 when the forming tool 26 shapes the metallic dome 66. More specifically, in one embodiment, the draw punch insert 24 only contacts a radially outward portion of the metallic dome 66. The portion of the metallic dome 66 contacted by the draw punch insert 24 is closer to the countersink 74 than to the flattened relief panel 90. In one embodiment, only an annular ring of the draw punch insert 24 contacts the metallic dome during forming by the tooling assembly 18.

Figure 5:
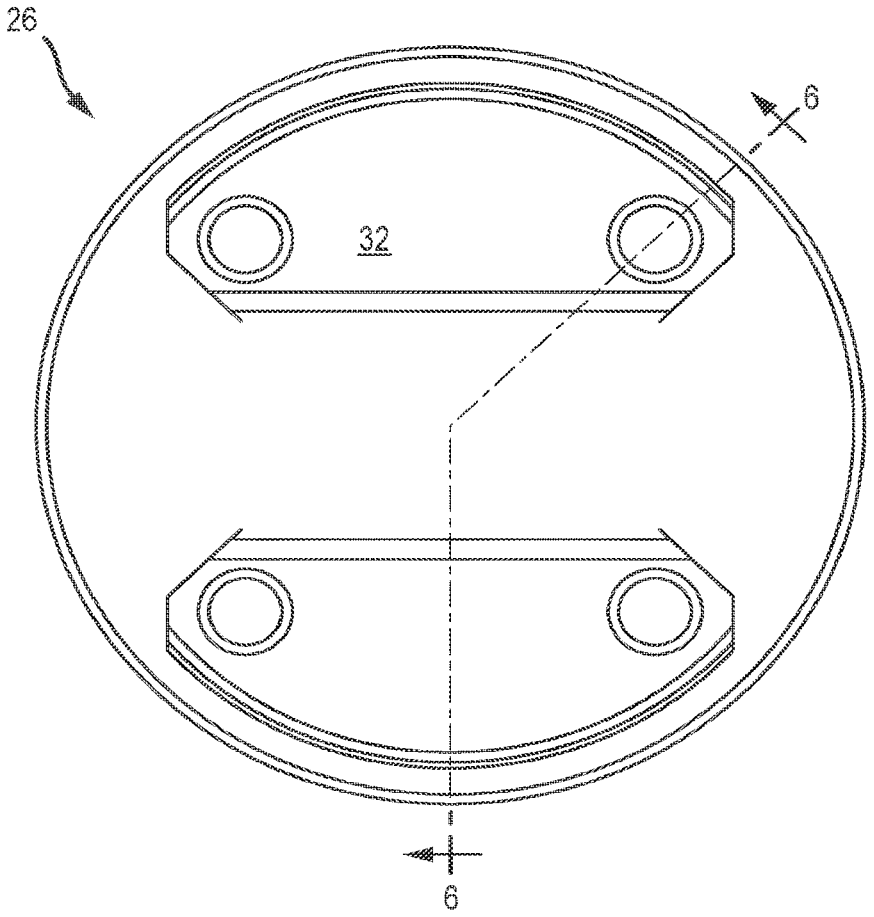
FIG. 5 is a bottom plan view of the forming tool of FIG. 2.
Figure 6:
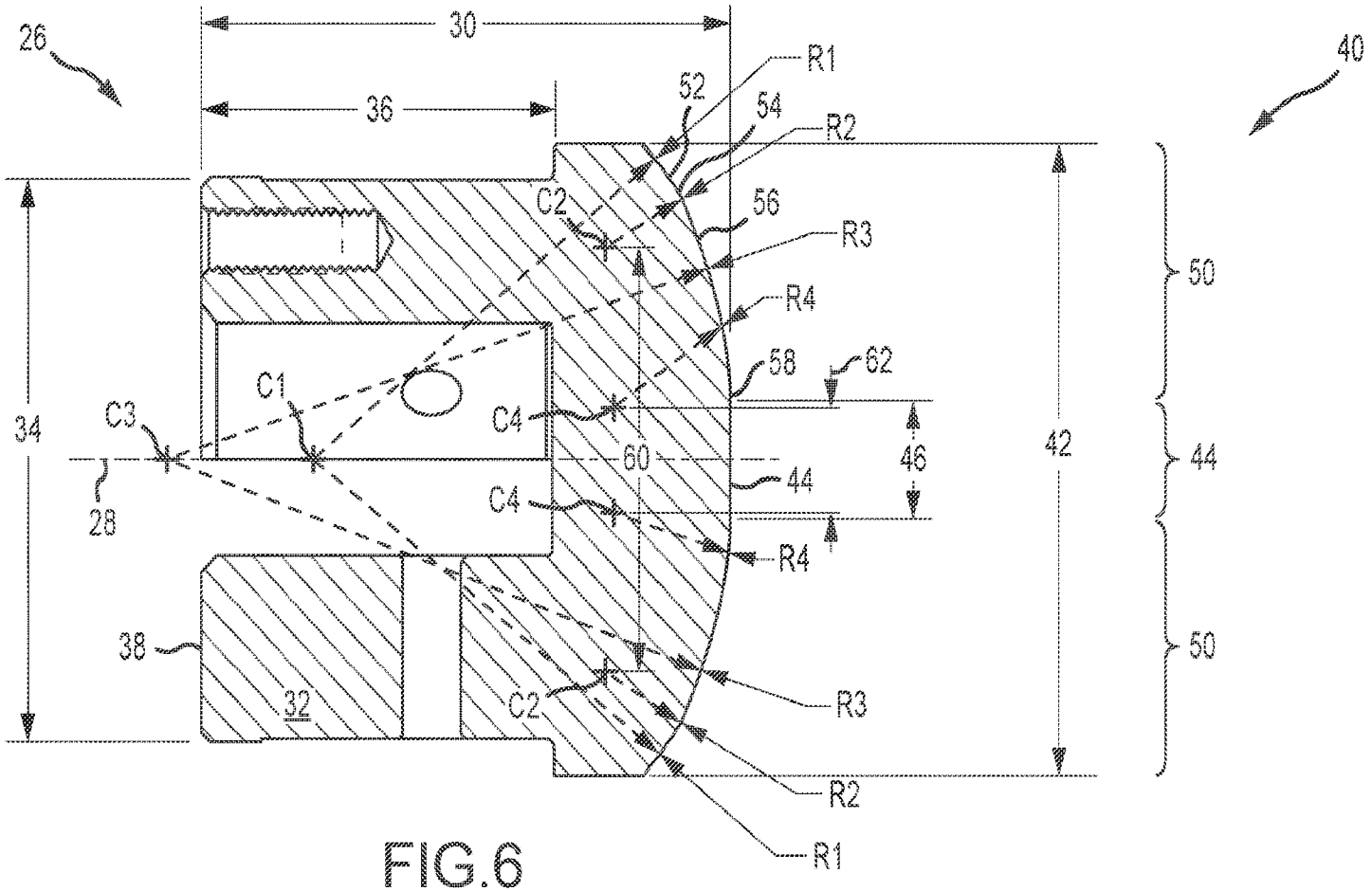
FIG. 6 is a cross-sectional view of the forming tool taken along line 6-6 of FIG. 5.

Referring now to FIG. 5-6, one embodiment of a forming tool 26 of the present invention is illustrated. The forming tool 26 is sized to shape a metallic dome 66 configured to seal a 210 diameter aerosol container. However, as one of skill in the art will appreciate, the dimensions of the forming tool 26 may be altered to shape metallic domes sized to seal aerosol containers of other diameters. The forming tool 26 generally includes a body portion 32 configured to be interconnected to the tooling assembly 18. In one embodiment of the present invention, the forming tool 26 has a body portion 32 configured to be interconnected to a prior art tooling assembly in place of a prior art dome forming tool. In this manner, the prior art tooling assembly can be adapted to form metallic domes 66 of the present invention by substitution of only one prior art tool in the tooling assembly with the forming tool 26 of one embodiment of the present invention.

Referring now to FIG. 6, some dimensions of the forming tool 26 are described. Applicant has found that the geometry of features of the face 40 must have specific proportional relationships to shape metallic domes 66 that consistently deform outwardly at predetermined pressures and without prematurely buckling or buckling only partially.

The forming tool 26 has a predetermined height 30 and maximum diameter 42. In one embodiment, the height 30 is between approximately 2.1 inches and approximately 2.4 inches. In another embodiment, the maximum diameter 42 is between approximately 2.3 inches and approximately 2.6 inches. The body portion 32 has an exterior diameter 34 of between approximately 2.0 inches and approximately 2.3 inches and a height 36 of between approximately 1.35 inches and approximately 1.65 inches. The height 30, diameter 34, and shape of the body portion 32 may be changed as necessary for interconnection to various tooling assemblies.

The face 40 includes an outwardly oriented arch 50 and a flat portion 44. The flat portion 44 is substantially planar and generally centered on a longitudinal axis 28 of the forming tool 26. The flat portion 44 has a predetermined diameter 46. In one embodiment, the diameter 46 of the flat portion 44 has a predetermined relationship to the maximum diameter 42 of the forming tool 26. More specifically, in one embodiment, the flat portion diameter 46 is between approximately 17.0 percent and approximately 21.0 percent of the forming tool diameter 42. Additionally, or alternatively, in another embodiment, the diameter 46 is between approximately 0.40 inches and approximately 0.58 inches. In another embodiment, the flat portion diameter 46 is between approximately 0.43 inches and approximately 0.49 inches.

In one embodiment, the outwardly oriented arch 50 has a substantially constant radius of curvature. Alternatively, the face 40 includes one or more of a first outwardly oriented arch 52 with a first radius of curvature R1, a second outwardly oriented arch 54 with a second radius of curvature R2, and a third outwardly oriented arch 56 with a third radius of curvature R3. Optionally, the face 40 may also include a fourth outwardly oriented arch 58 with a fourth radius of curvature R4.

In one embodiment, the first radius of curvature R1 is at least approximately three times greater than the second radius of curvature R2. In another embodiment, the second radius of curvature R2 is approximately one-fifth (or 20 percent) of the first radius of curvature R1.

In another embodiment, the first radius of curvature R1 is less than the third radius of curvature R3. In one embodiment, the first radius of curvature R1 is approximately 75% of the third radius of curvature R3. Optionally, the second radius of curvature R2 may be approximately 15% of the third radius of curvature R3.

In one embodiment, the fourth radius of curvature R4 is less than each of the first radius of curvature R1 and the third radius of curvature R3. Accordingly, in one embodiment, the third radius of curvature R3 is at least approximately three times greater than the fourth radius of curvature R4. In another embodiment, the fourth radius of curvature R4 is approximately 20 percent of the third radius of curvature R3. In yet another embodiment, the relationship of radii of curvature R1-R4 may be described as:

$$\left(\frac{4}{3}\times R1\right)\approx\left(\frac{20}{3}\times R2\right)\approx R3\approx(5\times R4)$$

The second and fourth radii of curvature R2, R4 have respective second and fourth centers C2, C4 which are offset from the longitudinal axis 28 of the forming tool 26 by predetermined amounts. The centers C2, C4 define diameters 60, 62 with specific relationships to the forming tool diameter 42. More specifically, in one embodiment, the second centers C2 of the second radius of curvature R2 define a diameter 60 that is between approximately 65% and approximately 70% of the forming tool diameter 42. In another embodiment, the fourth centers C4 of the fourth radius of curvature R4 define diameter 62 that is between approximately 15% and approximately 18.5% of the forming tool diameter 42. In one embodiment, diameter 62 is between approximately 21% and approximately 25% of diameter 60.

In one embodiment, the first radius of curvature R1 is between approximately 1.7 inches and approximately 2.1 inches or, in another embodiment, between approximately 1.8 inches and approximately 2.0 inches. A first center C1 of the first radius of curvature R1 may optionally be offset from the longitudinal axis 28 by less than approximately 0.1 inches. The first center C1 may be positioned within the forming tool 26 and between approximately 0.2 inches and approximately 0.7 inches from a distal end 38 of the body portion 32.

Optionally, the second radius of curvature R2 may be between approximately 0.2 inches and approximately 0.6 inches or, in another embodiment, between approximately 0.3 and approximately 0.5 inches. The second center C2 of the second radius of curvature R2 is offset from the longitudinal axis 28 by between approximately 0.75 inches and approximately 0.92 inches. In one embodiment, the second center C2 of the second radius of curvature R2 is within the forming tool 26 and separated from the body distal end 38 by between approximately 1.60 inches and approximately 1.85 inches.

The third radius of curvature R3 optionally is between approximately 2.25 inches and approximately 2.75 inches. In another embodiment, the third radius of curvature R3 is between approximately 2.4 inches and approximately 2.6 inches. The third center C3 of the third radius of curvature R3 is positioned between approximately 0.1 inches and approximately 0.4 inches beyond the distal end 38 of the body portion 32 outside of the forming tool 26.

In one embodiment, the fourth radius of curvature R4 is between approximately 0.3 inches and approximately 0.7 inches. Optionally, the fourth radius of curvature R4 is between approximately 0.4 inches and approximately 0.6 inches. Fourth centers C4 of the fourth radius of curvature R4 are positioned within the forming tool 26 and spaced from the longitudinal axis 28 by between approximately 0.05 inches and approximately 0.35 inches.

Figure 7:
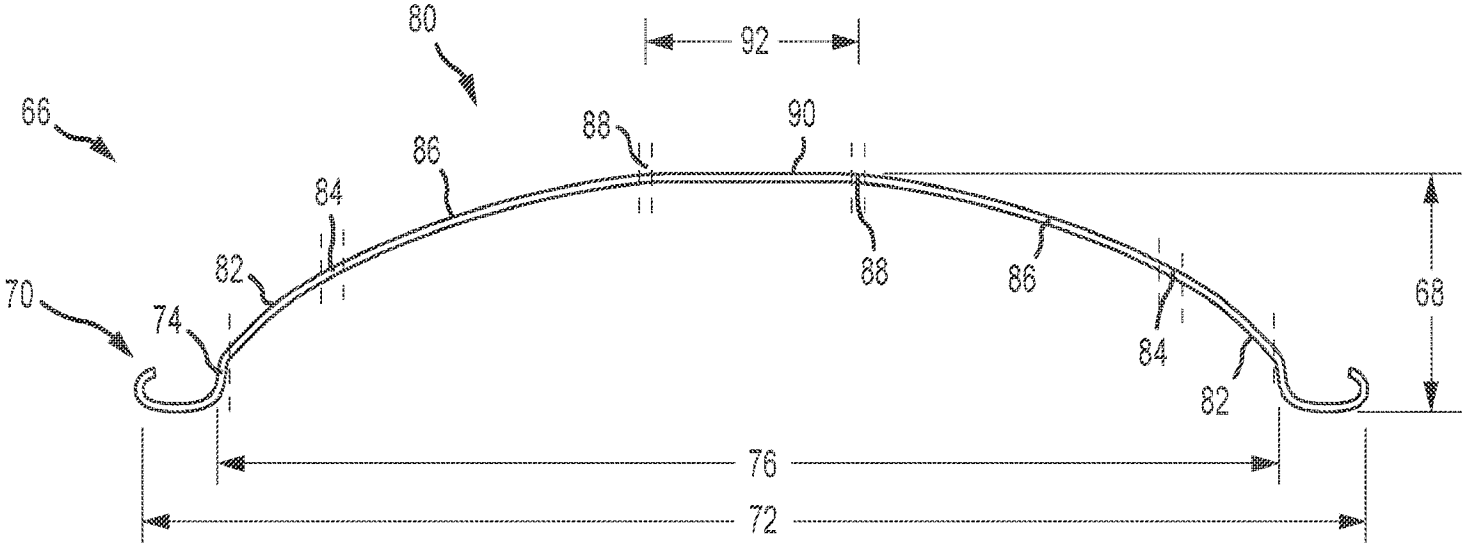
FIG. 7 is a cross-sectional elevation view of a metallic dome of one embodiment of the present invention taken along a diameter of the metallic dome.

Referring now to FIG. 7, a metallic dome 66 of one embodiment of the present invention shaped by the forming tool 26 of FIGS. 5-6 is illustrated. The metallic dome 66 generally includes a peripheral curl 70, a countersink 74, an inwardly oriented arch 80 and a flattened relief panel 90. In one embodiment, no scores, coins, or areas of weakness are formed on the metallic dome. In another embodiment, the inwardly oriented arch 80 is free of scores, coins, and weakened areas. In yet another embodiment, the flattened relief panel 90 does not include scores, coins, or areas of weakness.

The metallic dome 66 has a predetermined height 68 and curl diameter 72. In one embodiment, the height 68 is between approximately 15% and approximately 18.5% of the curl diameter 72. Optionally, the height 68 is between approximately 0.30 inches and approximately 0.66 inches or between approximately 0.45 inches and approximately 0.51 inches. In one embodiment, the peripheral curl diameter 72 is between approximately 2.8 inches and approximately 2.98 inches. The countersink 74 defines an interior diameter 76 of the metallic dome 66. In one embodiment, the metallic dome may have an interior diameter 76 of between approximately 2.3 inches and approximately 2.65 inches. In one embodiment, the interior diameter 76 is measured at a tangency point of the chuckwall angle and a center 77 of the countersink radius of curvature (illustrated in FIG. 9).

The flattened relief panel 90 is substantially planar and generally centered within the dome 80. The flattened relief panel 90 has a diameter 92. The diameter 92 is measured from a sharp corner of the arched portion. In one embodiment, diameter 92 is between approximately 0.39 inches and approximately 0.52 inches. In another embodiment, the flattened relief panel diameter 92 is between approximately 18% and approximately 20% of the countersink diameter 76. Alternatively, in another embodiment, the flattened relief panel diameter 92 is between approximately 18.2% and approximately 19.2% of the countersink diameter 76. In one embodiment, the flattened relief panel 90 has a surface area that is between approximately 2.0% and approximately 5.6% of a surface area of the metallic dome 66.

In one embodiment, the inwardly oriented arch 80 has a substantially constant radius of curvature. Alternatively, the metallic dome 66 may include one or more inwardly oriented arches 82, 84, 86, 88. Each of the inwardly oriented arches 82-88 may have different radii of curvature which have been formed to increase the overall performance and yield strength of the dome. In one embodiment, the first inwardly oriented arch 82 has a radius of curvature of between approximately 1.5 inches and approximately 2.3 inches. In another embodiment, the second inwardly oriented arch 84 has a radius of curvature of between approximately 0.18 inches and approximately 0.66 inches. The third inwardly oriented arch 86, in one embodiment, has a radius of curvature of between approximately 2.0 inches and approximately 3.0 inches. In still another embodiment, the fourth inwardly oriented arch 88 has a radius of curvature of between approximately 0.27 inches and approximately 0.77 inches. As will be appreciated by one of skill in the art, the arches 82, 84, 86, 88 can have a variety of other radii depending on the type or thickness of material used to form the dome, the size of the dome, the size of the container, the amount of interior pressure the container is designed to hold, the volume of the container, and the type of product stored within the container. Accordingly, the arches 82, 84, 86, 88 may have other radii of curvature in different embodiments.

The flattened relief panel 90 is interconnected to an innermost portion of one of the inwardly oriented arches 82-88. In one embodiment, the flattened relief panel 90 is interconnected to an innermost portion of the fourth inwardly oriented arch 88. Alternatively, the flattened relief panel 90 is interconnected to an innermost portion of the third inwardly oriented arch 86.

In one embodiment, the first inwardly oriented arch 82 is shaped by the first outwardly oriented arch 52 of the forming tool 26. Similarly, the second inwardly oriented arch 84 can be shaped by the second outwardly oriented arch 54, the third inwardly oriented arch 86 can be shaped by the third outwardly oriented arch 56, and the fourth inwardly oriented arch 88 can be shaped by the fourth outwardly oriented arch 58.

Figure 9:
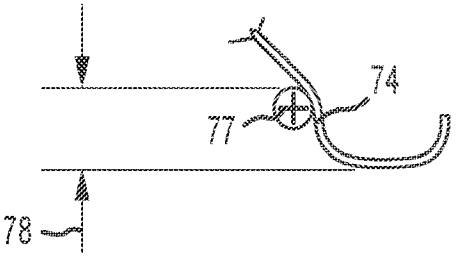
FIG. 9 is another expanded view of the peripheral portion of the metallic dome of FIG. 8 after the peripheral curl is at least partially formed.
Figure 8:
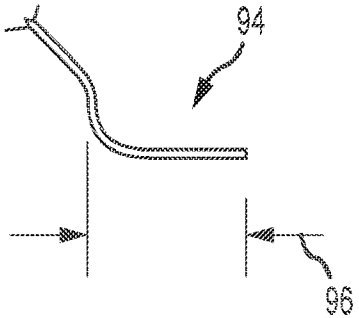
FIG. 8 is an expanded view of a peripheral portion of the metallic dome of FIG. 7 before a peripheral curl is formed on the metallic dome.

Referring now to FIG. 8, before the peripheral curl is formed, the metallic dome 66 may have a brim 94 with a width 96 of between approximately 0.18 inches and approximately 0.38 inches. As shown in FIG. 9, in one embodiment the countersink 74 has a depth 78 of between approximately 0.06 inches and approximately 0.18 inches. Optionally, the countersink radius of curvature is approximately 0.025 inches and is substantially centered at point 77. In another embodiment, the countersink radius of curvature is between approximately 0.020 inches and approximately 0.040 inches.

Figure 12:
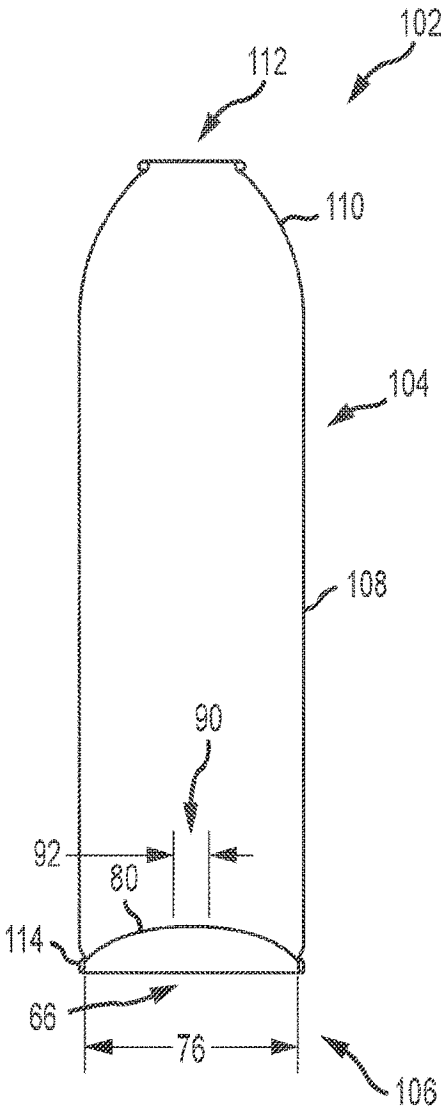
FIG. 12 is a cross-sectional view of the two-piece aerosol container taken along line 12-12 of FIG. 11.
Figure 11:
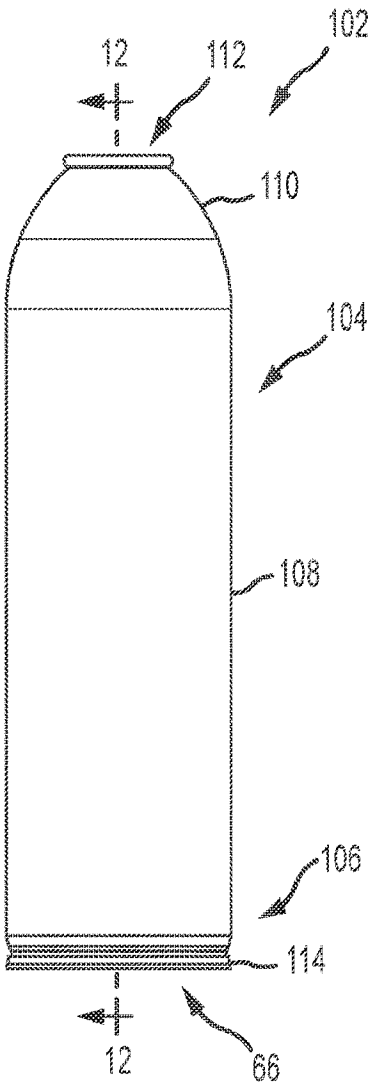
FIG. 11 is a front elevation view of the two-piece aerosol container of FIG. 10.
Figure 10:
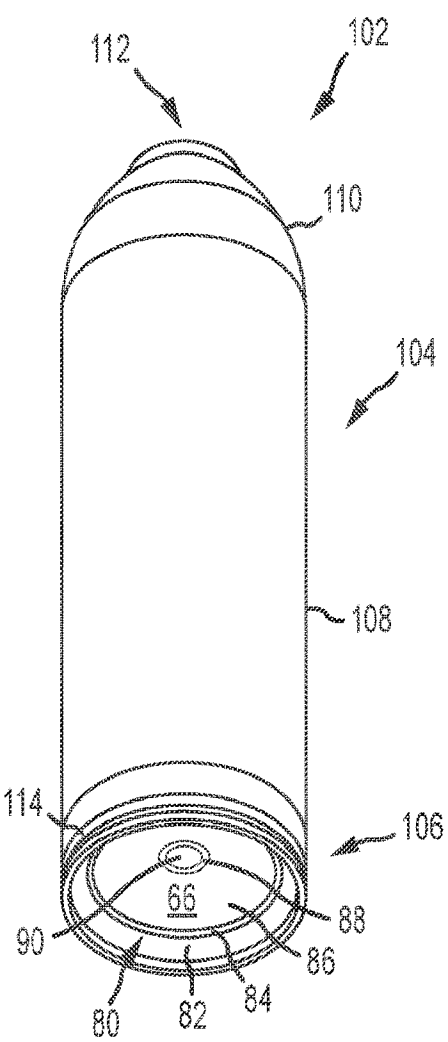
FIG. 10 is a perspective view of a two-piece aerosol container of one embodiment of the present invention, the aerosol container including a metallic dome of the present invention interconnected to a container body of the aerosol container.

Referring now to FIGS. 10-12, a two-piece aerosol container 102 of one embodiment of the present invention is illustrated. As will be appreciated by one of skill in the art, the aerosol container 102 may be of any size and shape. Specifically, the metallic dome 66 of embodiments of the present invention can be use with a container 102 of any size or shape and configured to hold any type of product. In one embodiment, the aerosol container 102 generally includes a container body 104 with an open end 106 sealed by a metallic dome 66. The container body 104 also includes a sidewall 108 that is substantially cylindrical, a shoulder 110 with a decreased diameter, and an opening 112 at an uppermost portion of the shoulder 110. The sidewall 108 proximate to the open end 106 may have a decreased diameter. The metallic dome 66 of one embodiment of the present invention has been interconnected to the sidewall 108 at the open end 106. The metallic dome 66 may be seamed 114 to the sidewall 108 by methods known to those of skill in the art. In one embodiment, the seam 114 is a double seam which interconnects the metallic dome 66 to the container body 104. The aerosol container 102 may be of any diameter and height. Further, other shapes of the shoulder 110 are contemplated. In another embodiment, the aerosol container 102 may include an upper end closure seamed to the container body 108 to form a 3-piece aerosol container.

Figure 13B:
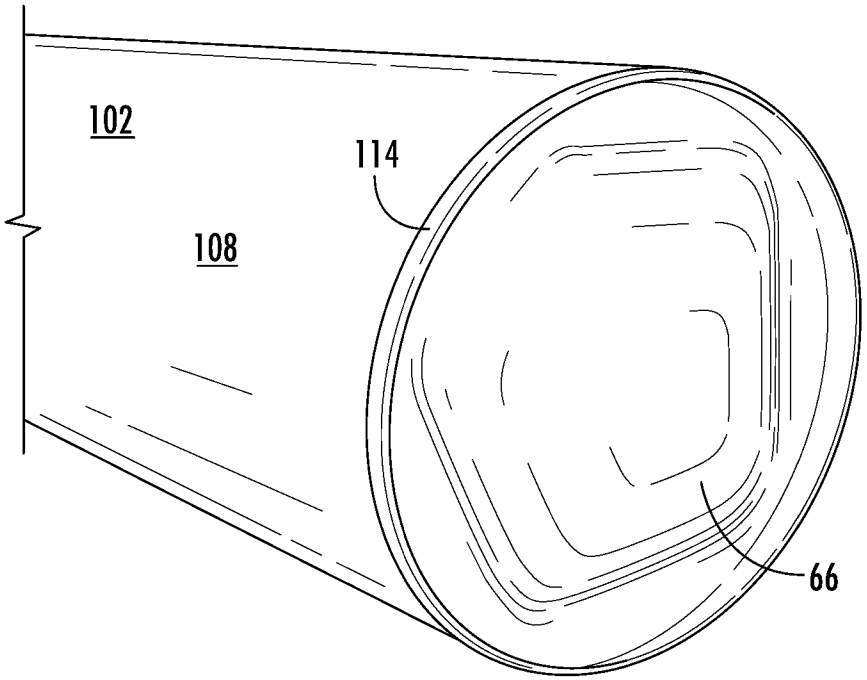
FIGS. 13A, 13B are photographs of a two-piece aerosol container of one embodiment of the present invention showing a metallic dome of the present invention which has deformed outwardly to relieve pressure within the aerosol container.
Figure 13A:
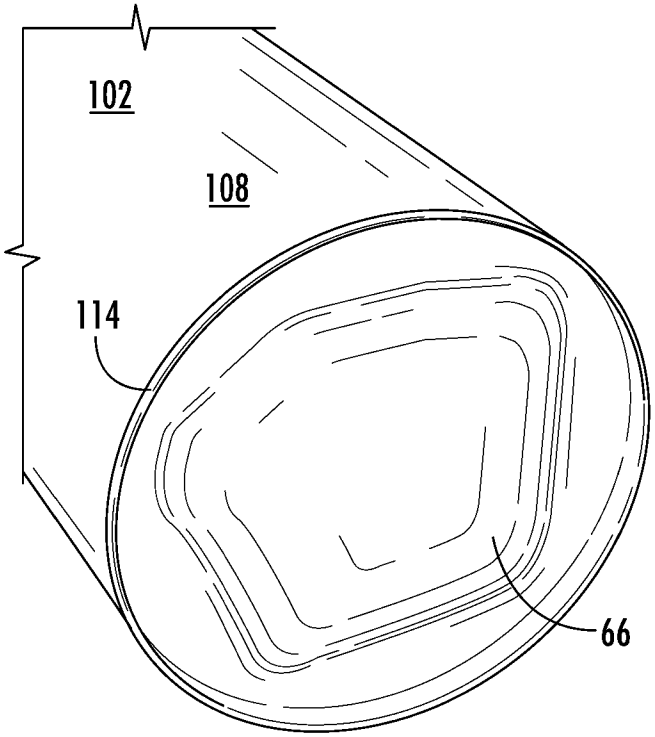

Referring now to FIGS. 13A, 13B, photographs of an aerosol container 102 of the present invention are provided. The pressure within the aerosol container 102 was increased to test the ability of the metallic dome 66 to deform to relieve pressure within the aerosol container. In response to the increased pressure, the metallic dome 66 deformed outwardly to increase the volume of the aerosol container 102 and decrease the pressure within the aerosol container. The metallic dome 66 deformed at less than approximately 275 psig. More specifically, the metallic dome 66 deformed when the pressure within the aerosol container 102 reached between approximately 225 psig and approximately 230 psig. The seam 114 which interconnects the metallic dome 66 to the sidewall 108 did not unravel or vent the gas from within the aerosol container 102. Additionally, no sharp edges were created on the end closure 66 when the inwardly oriented arch 80 deformed outwardly.

Figure 14B:
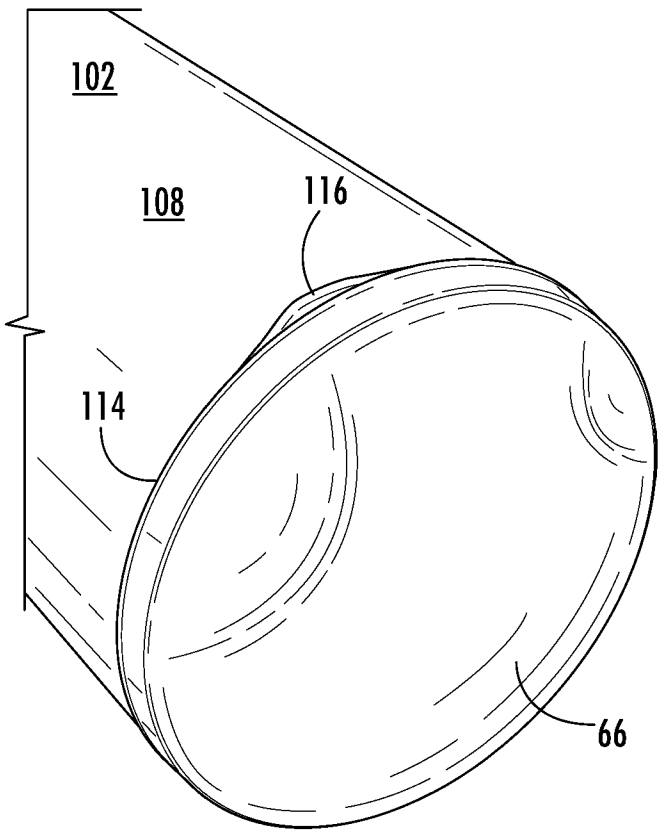
FIGS. 14A, 14B are photographs of another two-piece aerosol container in which a metallic dome of one embodiment of the present invention has deformed outwardly to reduce pressure and subsequently separated partially from the container body as pressure continued to increase within the aerosol container.
Figure 14A:
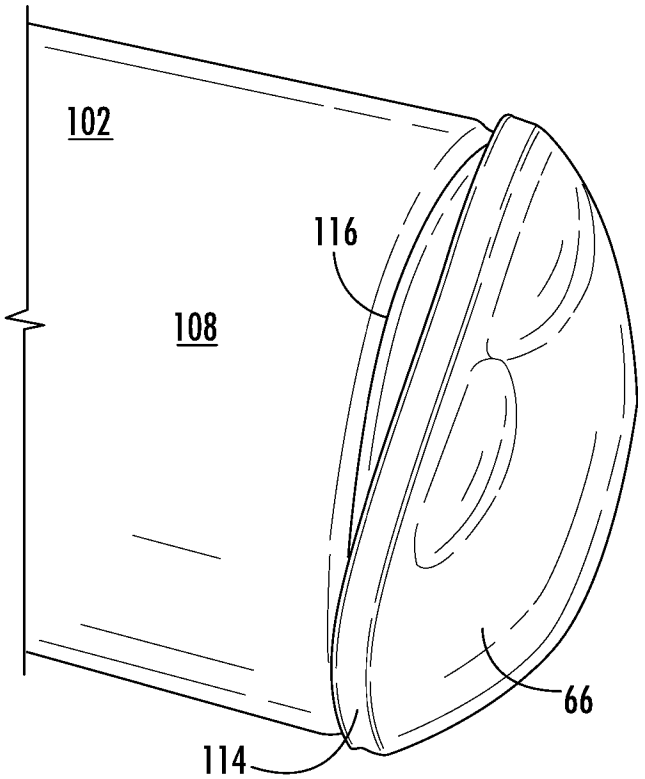

Referring now to FIGS. 14A, 14B, photographs of another aerosol container 102 of the present invention are provided. The metallic dome 66 was tested to failure by increasing the pressure within the container beyond approximately 275 psig. More specifically, pressure within the aerosol container 102 was increased until the metallic dome 66 deformed outwardly at approximately 225 psig. Pressure within the aerosol container 102 decreased due to the increased volume associated with the outward deformation of the metallic dome 66. However, pressure within the container 102 was then further increased and the metallic dome 66 continued to distend outwardly. The metallic dome 66 of FIG. 14 accordingly deformed outwardly a greater distance than the metallic dome 66 of FIG. 13. When pressure within the container 102 reached between approximately 275 psig, and approximately 280 psig, the seam 114 unraveled forming a gap 116 between the metallic dome 66 and the sidewall 108. Pressure within the aerosol container 102 decreased as gas vented through the gap 116.

Figure 15A:
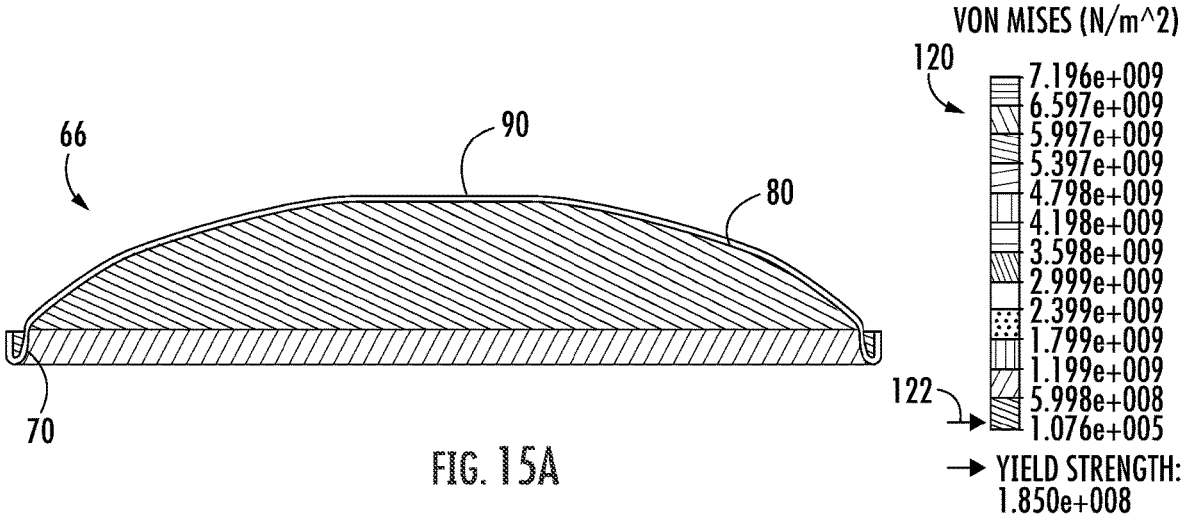
FIGS. 15A-15C illustrate forces experienced by a metallic dome of the present invention when pressure within an aerosol container is at various levels.
Figure 15B:
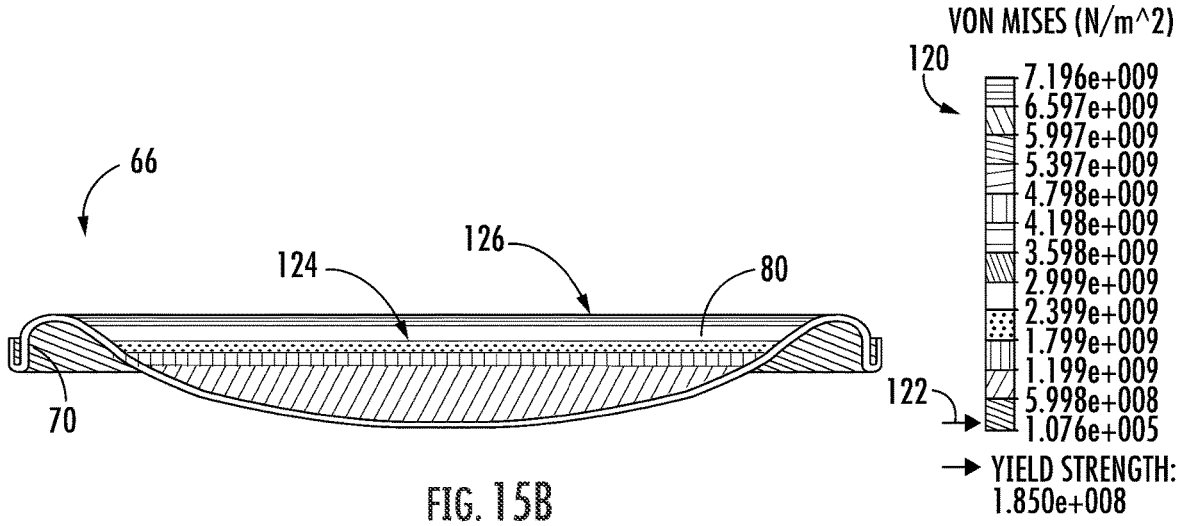
Figure 15C:
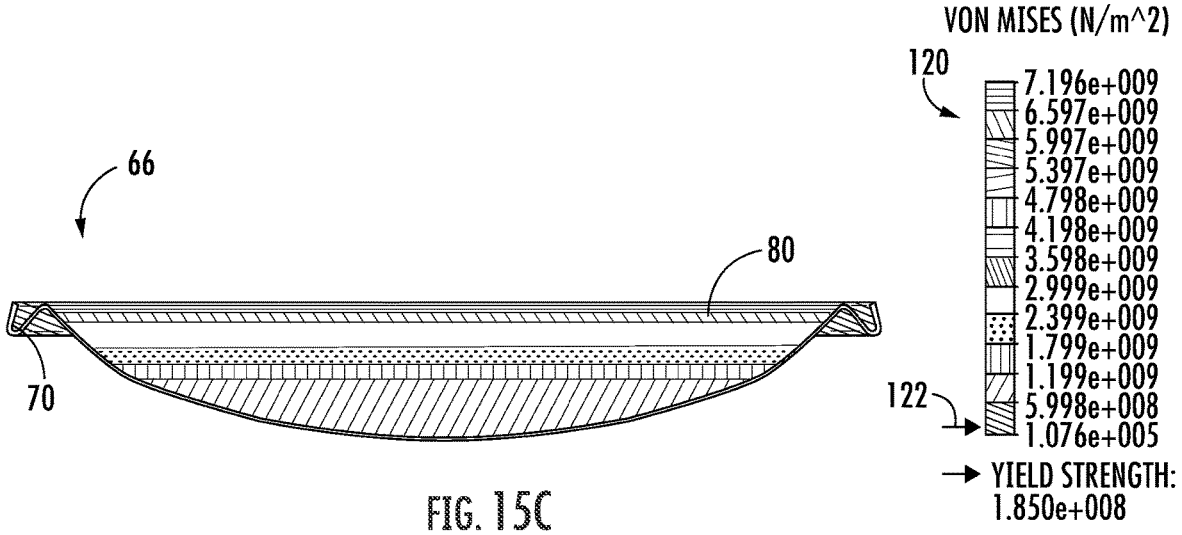

Referring now to FIGS. 15A-15C, forces on a metallic dome 66 of the present invention at different pressures within an aerosol container are generally illustrated in finite element analysis plots. The aerosol container to which the metallic dome is interconnected is not illustrated for clarity. As will be appreciated by one of skill in the art, the metallic dome 66 can be interconnected to aerosol containers of a variety of sizes and shapes. The metallic dome 66 will fail when the material of the peripheral curl 70 yields as a result of excessive internal pressure. The predicted yield strength of the material of the metallic dome is approximately $$1.850\times10^{8}\frac{N}{m^{2}}.$$

Stress scale 120 illustrates stresses on the metallic dome 66 measured in $$\frac{N}{m^{2}}.$$

The predicted yield strength of $$1.850\times10^{8}\frac{N}{m^{2}}$$

is indicated by line 122 on the stress scale 120.

FIG. 15A illustrates forces on a metallic dome 66 when pressure within the aerosol container is less than 220 PSIG. As illustrated, the stress on the metallic dome 66 is less than the yield strength of approximately $$1.850\times10^{8}\frac{N}{m^{2}}$$

when pressure in the container is less than 220 PSIG. Accordingly, the arched portion 80 does not buckle and the peripheral curl 70 retains its shape preventing release of product from the container.

FIG. 15B illustrates the metallic dome 66 of FIG. 15A when pressure within the aerosol container is approximately 220 PSIG. Stress at a first portion 124 of the arched portion 80 exceeds approximately $$1.199\times10^{9}\frac{N}{m^2}$$

and stress at a second portion 126 near the peripheral curl 70 exceeds approximately $$2.199\times10^{9}\frac{N}{m^2}.$$

Accordingly, the inwardly oriented arch 80 of the metallic dome has begun to deform outwardly, increasing the volume of the aerosol container and decreasing pressure within the aerosol container. However, the stress at the peripheral curl 70 is less than the yield strength of $$1.850\times10^{8}\frac{N}{m^2}$$

and the peripheral curl has retained its shape, preventing the release of product from within the container.

FIG. 15C illustrates the metallic dome of FIGS. 15A, 15B when pressure within the aerosol container is increased to approximately 280 PSIG. As the pressure increased above 220 PSIG, stress on the peripheral curl 70 increases to greater than approximately $$4.198\times10^{9}\frac{N}{m^2}$$

and the inwardly oriented arch 80 has distended outwardly further than in FIG. 15B. At approximately 280 PSIG, the material of the peripheral curl 70 has yielded and separated at least partially from the container body. More specifically, the aerosol container burst and pressure released from the aerosol container.

The description of the present invention has been presented for purposes of illustration and description, but is not intended to be exhaustive or limiting of the invention to the form disclosed. Many modifications and variations will be apparent to those of ordinary skill in the art. The embodiments described and shown in the figures were chosen and described in order to best explain the principles of the invention, the practical application, and to enable those of ordinary skill in the art to understand the invention.

While various embodiments of the present invention have been described in detail, it is apparent that modifications and alterations of those embodiments will occur to those skilled in the art. Moreover, references made herein to "the present invention" or aspects thereof should be understood to mean certain embodiments of the present invention and should not necessarily be construed as limiting all embodiments to a particular description. It is to be expressly understood that such modifications and alterations are within the scope and spirit of the present invention, as set forth in the following claims.

What is claimed is:

1. A forming tool to shape a metallic dome for an aerosol container, the metallic dome having a geometry configured to deform in response to a predetermined pressure within the aerosol container, comprising:

a body portion configured to be interconnected to a tooling assembly; and a face portion to shape an inwardly oriented arch of the metallic dome, the face portion having a first diameter and including:

a first outwardly oriented arch with a first radius of curvature;

a second outwardly oriented arch interconnected to the first outwardly oriented arch, the second outwardly oriented arch having a second radius of curvature wherein the second radius of curvature is less than the first radius of curvature; and a flattened portion, interconnected to the second outwardly oriented arch, wherein the flattened portion is substantially linear and includes a second diameter that is between 17.0% and 21.0% of the first diameter.

2. The forming tool of claim 1, wherein the face portion further comprises a third outwardly oriented arch interconnected between the second outwardly oriented arch and the flattened portion, the third outwardly oriented arch having a third radius of curvature that is greater than the first radius of curvature.

3. The forming tool of claim 2, wherein the face portion further comprises a fourth outwardly oriented arch interconnected between the third outwardly oriented arch and the flattened portion, the fourth outwardly oriented arch having a fourth radius of curvature that is one-fifth of the third radius of curvature.

4. The forming tool of claim 1, wherein the second radius of curvature is less than one-fourth of the first radius of curvature.

5. The forming tool of claim 1, wherein the second radius of curvature is one-fifth of the first radius of curvature.

6. The forming tool of claim 1, wherein the second radius of curvature has a center forming a third diameter, the third diameter being between 65% and 70% of the first diameter.

7. The forming tool of claim 1, wherein the flattened portion is configured to form a flattened relief panel in the metallic dome, wherein the exterior surface of the flattened relief panel is not scored.

8. The forming tool of claim 7, wherein the forming tool is configured to form a metallic dome that is devoid of scores and coins.

9. The forming tool of claim 1, wherein the flattened portion is configured to form a flattened relief panel in the metallic dome, wherein the flattened relief panel has a relief panel diameter which is between 18.0% and 19.4% of an interior diameter of a peripheral curl.

10. The forming tool of claim 1, wherein the flattened portion is configured to form a corresponding flattened relief panel in the metallic dome, wherein the flattened relief panel has a surface area which is between 2.0% and 5.6% of the surface area of the metallic dome.

11. The forming tool of claim 1, wherein the forming tool is configured to form a metallic dome that has a height that is between 15% and 18.5% of an outermost diameter of a peripheral curl.

12. The forming tool of claim 1, wherein the flattened portion is substantially centered on a longitudinal axis of the forming tool.

13. A forming tool to shape a metallic dome for an aerosol container, the metallic dome having a geometry configured to deform in response to a predetermined pressure within the aerosol container, comprising:

a body portion configured to be interconnected to a tooling assembly; and a face portion to shape an inwardly oriented arch of the metallic dome, the face portion having a first diameter and including:

a first outwardly oriented arch with a first radius of curvature;

a second outwardly oriented arch interconnected to the first outwardly oriented arch, the second outwardly oriented arch having a second radius of curvature;

a flattened portion which is substantially linear and including a second diameter that is between 17.0% and 21.0% of the first diameter;

a third outwardly oriented arch interconnected to the second outwardly arch, the third outwardly oriented arch having a third radius of curvature that is greater than the first radius of curvature; and a fourth outwardly oriented arch interconnected to the third outwardly oriented arch and to the flattened portion, the fourth outwardly oriented arch having a fourth radius of curvature that is one-fifth of the third radius of curvature.

14. The forming tool of claim 13, wherein the second radius of curvature is less than one-fourth of the first radius of curvature.

15. The forming tool of claim 13, wherein the second radius of curvature is one-fifth of the first radius of curvature.

16. The forming tool of claim 13, wherein the second radius of curvature has a center forming a third diameter, wherein the third diameter is between 65% and 70% of the first diameter.

17. The forming tool of claim 13, wherein the flattened portion is configured to form a flattened relief panel in the metallic dome, wherein the exterior surface of the flattened relief panel is not scored.

18. The forming tool of claim 17, wherein the forming tool is configured to form a metallic dome that is devoid of scores and coins.

19. The forming tool of claim 13, wherein the flattened portion is configured to form a flattened relief panel in the metallic dome, wherein the flattened relief panel has a relief panel diameter which is between 18.0% and 19.4% of an interior diameter of a peripheral curl.

20. The forming tool of claim 13, wherein the flattened portion is configured to form a flattened relief panel in the metallic dome, wherein the flattened relief panel has a surface area which is between 2.0% and 5.6% of the surface area of the metallic dome.

21. The forming tool of claim 13, wherein the forming tool is configured to form a metallic dome that has a height that is between 15% and 18.5% of an outermost diameter of a peripheral curl.

22. The forming tool of claim 13, wherein the flattened portion is substantially centered on a longitudinal axis of the forming tool.

23. A forming tool to shape a metallic dome for an aerosol container, the metallic dome having a geometry configured to deform in response to a predetermined pressure within the aerosol container, comprising:

a body portion configured to be interconnected to a tooling assembly; and a face portion to shape an inwardly oriented arch of the metallic dome, the face portion having a first diameter and including:

a first outwardly oriented arch with a first radius of curvature, wherein the first radius of curvature is consistent, wherein the first outwardly oriented arch extends from a countersink forming portion of the face;

a second outwardly oriented arch interconnected to the first outwardly oriented arch, the second outwardly oriented arch having a second radius of curvature, wherein the second radius of curvature is less than the first radius of curvature, and wherein the second radius of curvature is consistent; and a flattened portion interconnected to the second outwardly oriented arch, wherein the flattened portion is substantially linear and including a second diameter that is between 17.0% and 21.0% of the first diameter.

* * * * *